US007505708B2

(12) United States Patent
Ohanyan et al.

(10) Patent No.: US 7,505,708 B2
(45) Date of Patent: Mar. 17, 2009

(54) METHODS AND APPARATUS FOR REMANUFACTURING TONER CARTRIDGES

(75) Inventors: Tigran Ohanyan, Burbank, CA (US); Raymond Hunt, Valencia, CA (US)

(73) Assignee: Future Graphics Imaging Corporation, San Fernando, CA (US)

( * ) Notice: Subject to any disclaimer, the term of this patent is extended or adjusted under 35 U.S.C. 154(b) by 0 days.

(21) Appl. No.: 11/700,605

(22) Filed: Jan. 31, 2007

(65) Prior Publication Data

US 2008/0181657 A1 Jul. 31, 2008

(51) Int. Cl.
*G03G 15/00* (2006.01)
*G03G 13/06* (2006.01)

(52) U.S. Cl. ..... 399/109; 399/111

(58) Field of Classification Search ..... 399/109, 399/111; 264/36.1; 29/402.08
See application file for complete search history.

(56) References Cited

U.S. PATENT DOCUMENTS 4,257,166 A * 3/1981 Barker et al. ..... 408/241 G
4,816,877 A * 3/1989 Keen ..... 355/133
5,531,846 A * 7/1996 Miraglia et al. ..... 156/64
5,676,794 A * 10/1997 Baley ..... 156/584
5,839,028 A * 11/1998 Nomura et al. ..... 399/109
6,484,001 B1 * 11/2002 Sirejacob ..... 399/109
6,721,520 B2 * 4/2004 Higeta et al. ..... 399/109
6,754,460 B2 * 6/2004 Lewis et al. ..... 399/109
6,801,734 B1 * 10/2004 Jones et al. ..... 399/109
6,907,210 B2 * 6/2005 Wazana et al. ..... 399/109
7,215,903 B2 * 5/2007 Suzuki ..... 399/109
7,248,813 B2 * 7/2007 Burton ..... 399/109
2002/0041777 A1 * 4/2002 Sirejacob ..... 399/274
2004/0114959 A1 * 6/2004 Daniels ..... 399/109
2005/0069341 A1 * 3/2005 Mori ..... 399/109
2007/0217814 A1 * 9/2007 Causey et al. ..... 399/109

FOREIGN PATENT DOCUMENTS

JP 2002251119 A * 9/2002

* cited by examiner

*Primary Examiner*—David M Gray
*Assistant Examiner*—G. M. Hyder
(74) *Attorney, Agent, or Firm*—Roland Tong

(57) ABSTRACT

A device for manufacturing a printer cartridge, the printer cartridge having a doctor blade and a developer roller, the doctor blade being configured to regulate the amount of toner delivered to the developer roller, the device comprising: (a) first surface, the first surface lying on a first plane; and (b) a second surface positioned opposite the first surface, the second surface lying on a second plane, the first and the second plane being parallel to each other, the second surface comprising a flat portion, the flat portion being configured to contact a portion of the doctor blade, wherein when the flat portion contacts the doctor blade portion, the device applies pressure to the doctor blade portion.

16 Claims, 5 Drawing Sheets

METHODS AND APPARATUS FOR REMANUFACTURING TONER CARTRIDGES

CROSS REFERENCES TO RELATED APPLICATIONS

None

FIELD OF INVENTION

The present invention relates to electrophotography, particularly methods and apparatus for manufacturing or remanufacturing toner cartridges.

BACKGROUND

Used printer cartridges of fax machines, copiers, inkjet printers, and laser printers are often remanufactured. The remanufacturing of printer cartridges may include cleaning, repairing damaged parts, replacing worn parts, and adding toner. The parts of printer cartridges typically include a toner hopper, a waste hopper, primary charge roller (PCR), a developer roller, and a drum.

Generally, printers embed toner on paper by relying on electrical charges occurring within the printer cartridges. The toner is typically stored in the toner hopper and carries a negative charge. The drum is typically given a charge by the PCR. The charge of the drum is typically more positive than the charge of the toner, and thus the drum is able to attract the toner. Once the drum is given a charge by the PCR and a print pattern is set, the drum gets coated with toner.

The toner may be carried to the drum by the developer roller (sometimes referred to as a "mag roller"), which may also preserve the uniform electrical charge of the toner. A doctor blade (sometimes referred to as a "doctor bar") may be provided and positioned proximate to the developer roller with a predetermined distance. The doctor blade ensures that the right amount of toner sticks to the developer roller. If there is an excess amount of toner on the developer roller, the doctor blade scrapes off the excess amount. The developer roller then transfers the toner to the drum. The drum that is coated with toner then rolls over a sheet of paper, which is usually given a negative charge by the PCR. The charge of the paper is less negative than the charge of the toner, and thus the paper attracts the toner. The toner is embedded on the paper according to the print pattern.

The doctor blade and the developer roller are usually detached from printer cartridge during remanufacturing for cleaning. After cleaning, the doctor blade and the developer roller are reassembled together usually by hand and a screw driver. An assembler usually positions the doctor blade above the developer roller. The assembler would press on one side of the doctor blade then screw the same side of the doctor blade to the cartridge. The assembler would then execute the same steps on the remaining side.

The applicant has observed that this conventional method of assembly may not provide a uniform distance between the doctor blade and the developer roller from one side of the doctor blade to the other. As a result, the print quality may be affected, as the toner level on the developer roller is not effectively regulated by the doctor blade. One side of the roller may produce darker image than the other, or vice-versa. Methods and apparatus for effectively assembling the doctor blade proximate to the developer roller are desired and are addressed by the present invention.

Next, the toner hopper is typically refilled with toner during remanufacturing. Toner is typically introduced into the toner hopper either by drilling a hole, refilling the toner, then covering the hole, or by filling the toner hopper with toner through an existing toner hopper recess. Typically, these steps are executed by hand and a drill. At least one problem with the conventional technique is that the toner hopper is not secured throughout the process. The toner hopper may move during the drilling or the refilling steps, which may add to the time it takes to complete the refilling process. This additional time is undesirable in a high volume manufacturing environment. Moreover, the conventional technique may not produce uniform sized hopper holes for introducing the toner. Some hopper holes may be too small for refilling the toner, and some hopper holes may be too big to cover after refilling. Methods and apparatus for effectively refilling the cartridge with toner are desired and are addressed by the present invention.

BRIEF DESCRIPTION

A device for manufacturing a printer cartridge, the printer cartridge having a doctor blade and a developer roller, the doctor blade being configured to regulate the amount of toner delivered to the developer roller, the device comprising: (a) first surface, the first surface lying on a first plane; and (b) a second surface positioned opposite the first surface, the second surface lying on a second plane, the first and the second plane being parallel to each other, the second surface comprising a flat portion, the flat portion being configured to contact a portion of the doctor blade, wherein when the flat portion contacts the doctor blade portion, the device applies pressure to the doctor blade portion.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

The term "developer roller" is commonly used in the cartridge manufacturing industry to refer to typically cylindrical material in a printer cartridge that attracts toner usually by static charge and is typically positioned in between a doctor blade and a drum. In some cartridges, the developer roller may be magnetized and may be referred to as a "mag roller." When the cartridge is in operation, the developer roller typically rolls along with the drum to provide toner to the drum thereby allowing the drum to produce a print pattern to a paper that is being rolled around the drum. The term "doctor blade" is another commonly used term in the cartridge manufacturing industry, which refers to an elongated material that usually includes an elongated rod with an elongated blade attached to the elongated rod. The elongated rod is usually made of metal, and the elongated blade is typically made of plastic. The blade may be positioned at an angle from the rod and may be positioned next to the developer roller. When the cartridge is in operation, the doctor blade is typically stationary while the developer roller rolls next to the blade. Not all toner may be absorbed by the developer roller. The toner that is not absorbed by the developer roller typically accumulates around the developer roller. Since the doctor blade and the developer roller are separated by a relatively small predetermined space, the blade controls the thickness of the toner that adheres to the developer roller by scraping off toner that is not absorbed by the developer roller.

Figure 1:
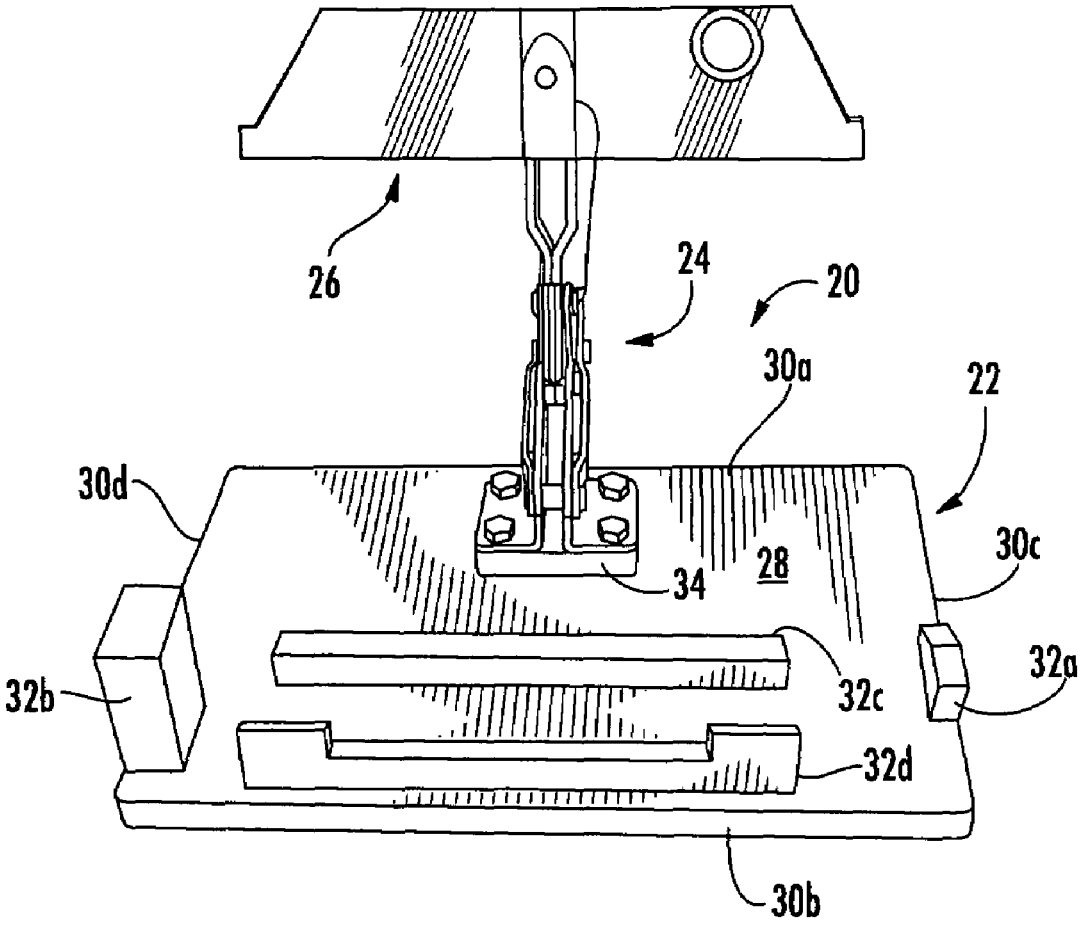
FIG. 1 is substantially a front elevational view of an embodiment of the cartridge assembly device of the present invention.

The present invention comprises a cartridge assembly device and related methods of use. Referring to FIG. 1, the cartridge assembly device 20 may include a fixture 22, a clamp 24, and a doctor blade press 26. The fixture 22 may serve as a device for supporting work during manufacturing or remanufacturing. The doctor blade press 26 may serve as a pressure material that applies pressure to the doctor blade (not shown in FIG. 1) to effectively position the doctor blade next to the developer or mag roller during cartridge assembly such that the doctor blade may effectively regulate the toner being delivered to the developer or mag roller and consequently enhance the resulting print quality of the printer cartridge. The doctor blade press 26 may also serve as a template for creating a toner refill hole, which is described further below. The clamp 24 may serve to enhance the functions of the doctor blade press 26 and the fixture 22.

The fixture 22 preferably includes a board material 28, which may serve as a base for the cartridge assembly device. The board material 28 may include four sides 30*a-d*, which form a plane. The board material 28 may further include a plurality of projections 32*a-d* configured to hold a toner hopper such that when the toner hopper is laid on the board material, each of the plurality of projections 32*a-d* cooperate to prevent the toner hopper from moving forward, backward, or side-to-side relative to the board material 28. It is noted the board material 28 may also be configured to hold an entire cartridge or cartridge portions other than the toner hopper. It is further noted that, terms relating to spatial orientation, such as "forward," "backward," and "side-to-side" are used herein for ease and clarity of description only. The invention is not limited by these spatial orientations and may be practiced without observing the descriptions that use these spatial orientations.

Board material 28 may include side projections 32*a* and 32*b* to restrict the movement of a toner hopper laid on the board material 28 by providing side walls that confine the toner hopper there between. The side projections 32*a* and 32*b* may be positioned parallel to the board sides 30*c* and 30*d*, respectively, and may be offset relative to each other. Side projections 32*a* and 32*b* may be configured to cause cartridge end caps to abut to them. The offset may help prevent the toner hopper from moving forward and backward relative to the board material 28 in the position shown in FIG. 1.

Board material 28 may also include a pair of parallel elongate projections 32*c* and 32*d* designed to cause a bottom portion of a toner hopper to abut to the projections 32*c* and 32*d* so that the toner hopper is prevented from moving forward and backward relative to the board material 28 in the position shown in FIG. 1. The pair of parallel elongate projections 32*c* and 32*d* may be positioned perpendicular to sides 30*c* and 30*d* and parallel to sides 30*a* and 30*b*. The sizes, shapes, orientations, and positions of the projections may vary depending on the design of the toner hopper, cartridge, or cartridge portion intended to be laid onto the board material 28. In certain embodiments, the board material may have indentations or holes (not shown) in lieu of projections, which may define walls that are configured hold the toner hopper, cartridge, or cartridge portion laid onto the board material. It can be realized that the fixture 22 of the present invention affixes the toner hopper, cartridge, or cartridge portion to a substantially steady position, which may be ideal for performing manufacturing or remanufacturing work on each of them, such as refilling the toner hopper and installing toner hopper components.

A clamp 24 may be mounted to a clamp platform 34 of the board material 28. Clamp 24 may be fastened to the clamp platform 34 using fasteners known in the art. The doctor blade press 26 may be attached to the clamp 24. It can be appreciated that the clamp 24 may move the doctor blade press 26 up and down relative to the board material 28. It can further be appreciated that the clamp 24 may provide a downward pressure to the doctor blade press 26, which may be beneficial in securing the doctor blade to the cartridge and positioning the doctor blade next to the developer, as described further below.

Figure 2:
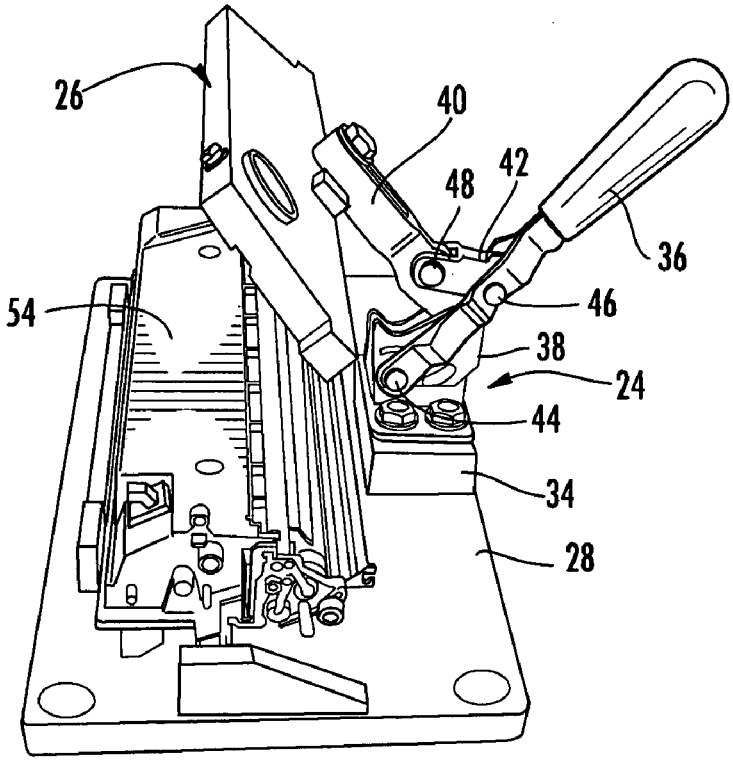
FIG. 2 is substantially a side view of the cartridge assembly device shown in FIG. 1 with a clamp at an angled position relative to the base.

Referring now to FIG. 2, clamp 24 may be a "hold down action" clamp from De-Sta-Co of Birmingham, Mich. The clamp 24 may include a handle 36, a clamp base 38, a first clamp arm 40, and a second clamp arm 42. One end of the first clamp arm 40 is preferably attached at the top of the doctor blade press 26, and the other end is preferably attached to the second clamp arm 42. The second clamp arm 42 may also be attached to the handle 36. The handle 36 is preferably attached to the clamp base 38.

The handle 36 may be moved from a position substantially perpendicular to the board material 28 to an angled position that is between approximately 90 degrees to 140 degrees from the center of the board material 28. When the handle 36 is moved from the perpendicular position to the angled position, the handle 36 preferably pivots around a first base pivot 44, which is attached to the clamp base 38. One end of the second clamp arm 42 preferably pivots around the handle pivot 46. The other end of the second clamp arm 42 preferably pivots around the arm pivot 48. The handle 36 and the second clamp arm 42 pull the first clamp arm 40 upward relative to the base material 28. When the first clamp arm 40 moves upward relative to the base material, the first clamp arm 40 preferably pivots around the second base pivot 50 (FIG. 3) that is attached to the clamp base 38. When the handle is at the angled position, the doctor blade press 26 is preferably not in contact with the toner hopper 54, cartridge, or cartridge portion positioned on the board material 28 (FIG. 2).

Figure 3:
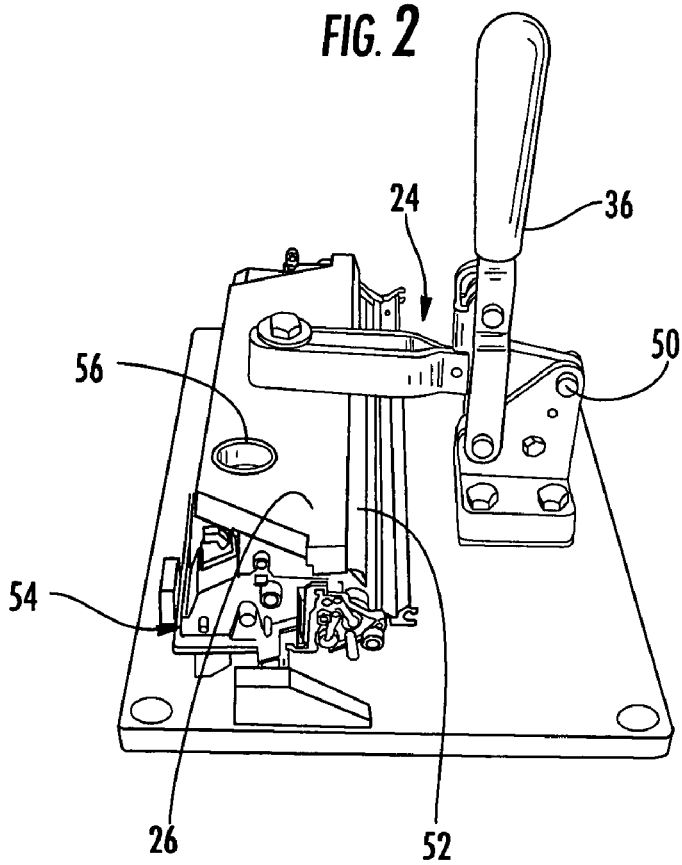
FIG. 3 is substantially a side view of the cartridge assembly device shown in FIG. 1 with the clamp at a perpendicular position relative to the base.

Referring now to FIG. 3, when the handle 36 is moved to the perpendicular position, the doctor blade press 26 preferably lays on top of the toner hopper. Thus, the toner hopper 54 is substantially prevented from moving vertically by the doctor blade press 26 and base material 28. The cartridge is also substantially prevented from moving horizontally by the projections 32*a-d* of the base material 28. It can be realized that the cartridge 54 may now be in a substantially steady position that is ideal for drilling a hole into the toner hopper so that the toner hopper may be refilled with toner.

With continued reference to FIG. 3, the doctor blade press 26 may serve as a refill hole template. Specifically, the doctor blade press 26 preferably includes a bottom surface that is configured to lay substantially flush on the toner hopper. The doctor blade press preferably defines a recess 56 of a predetermined size, which may be used as a guide for creating a refill hole on the toner hopper 54.

Figure 4:
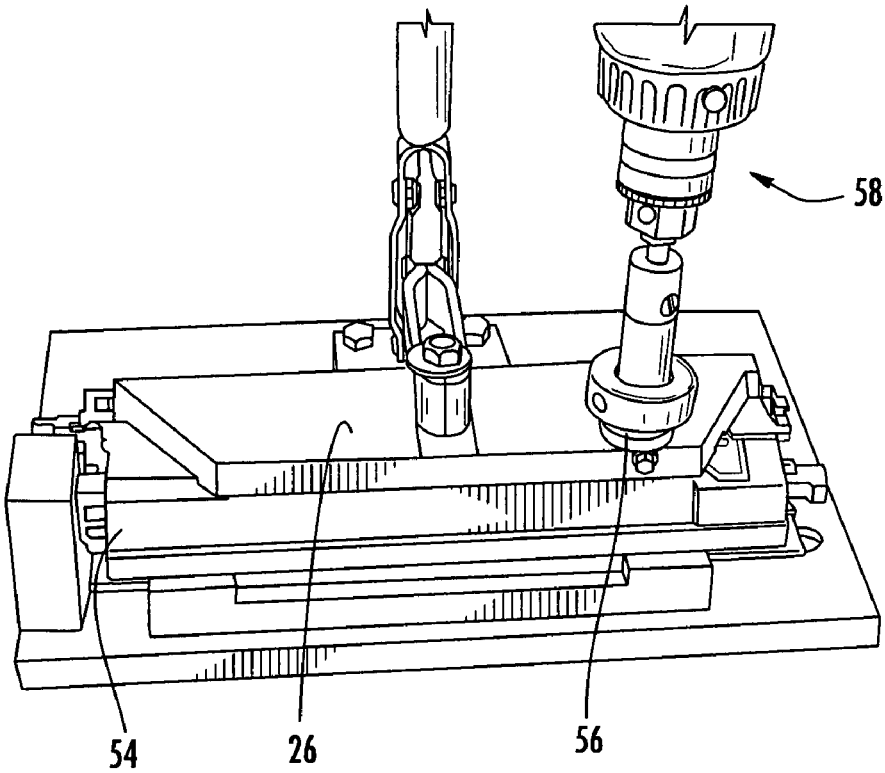
FIG. 4 is substantially a perspective view of the cartridge assembly device shown in FIG. 1 with a drill to cut a hole into the cartridge.
Figure 5:
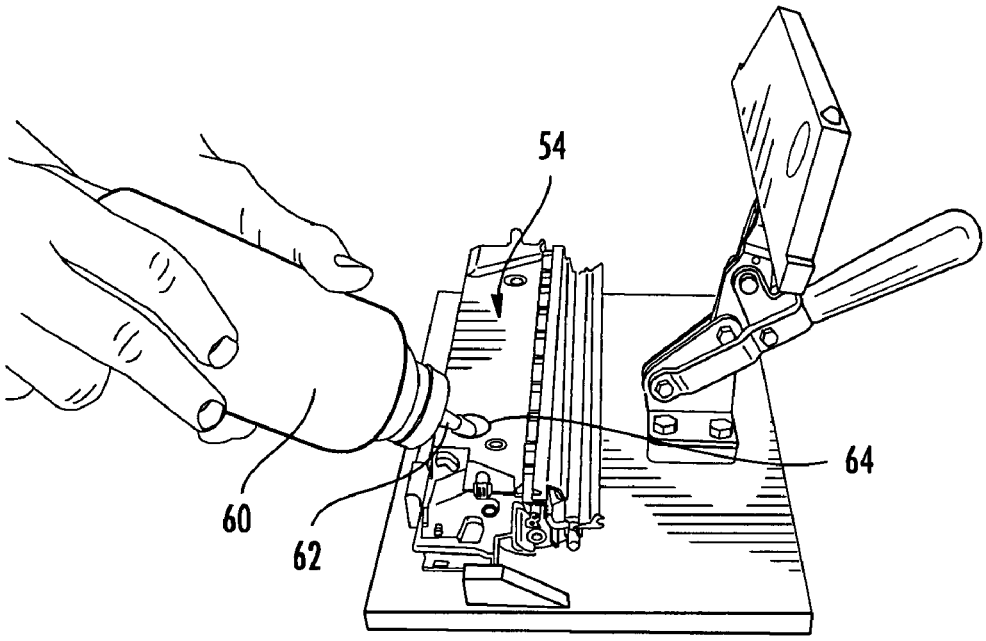
FIG. 5 is substantially a side view of the cartridge on the cartridge assembly device shown in FIG. 1 and the cartridge being refilled with toner.
Figure 6:
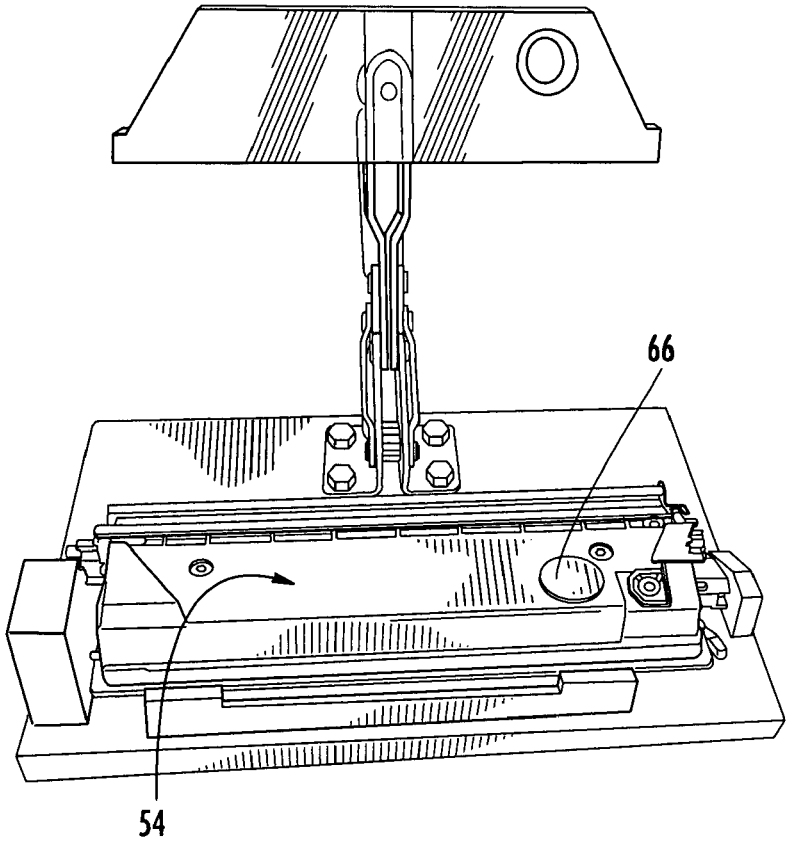
FIG. 6 is substantially a front elevational view of the cartridge refilled with toner in FIG. 5 and with the refill hole being covered.

Referring now to FIG. 4, a circular saw may be attached to a drill 58 and introduced into the recess 56. The drill may be activated to allow the circular saw to create a hole on the toner hopper of the cartridge 54. Referring now to FIG. 5, after the hole is created, the cartridge 54 may be refilled with toner from a toner bottle 60 with toner dispenser 62. The dispenser 62 may positioned next to the refill hole 64, and toner may be dispensed into the refill hole 64. After the desired amount of toner has been added into the toner hopper, the refill hole 64 may be sealed with a cover 66 (FIG. 6). The cover 66 may have an adhesive backing, which may adhere to the toner hopper when placed in contact with a toner hopper surface.

Figure 7:
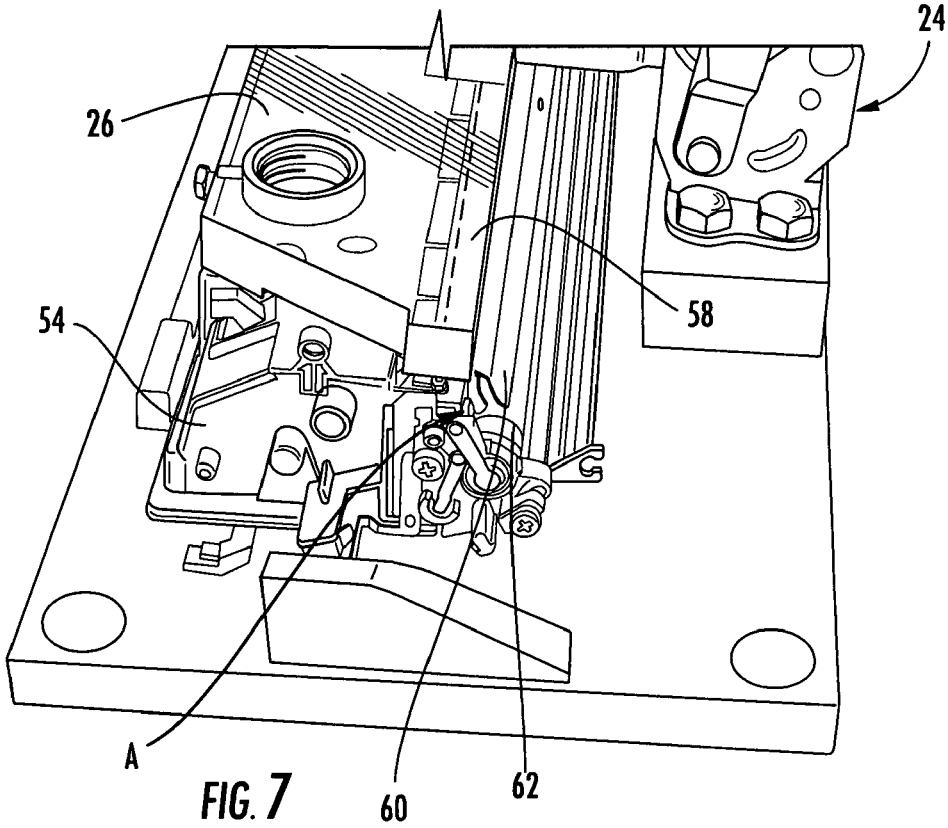
FIG. 7 is substantially a side partial view of the cartridge assembly device shown in FIG. 1 with the doctor blade being positioned for attachment to the printer cartridge.
Figure 8:
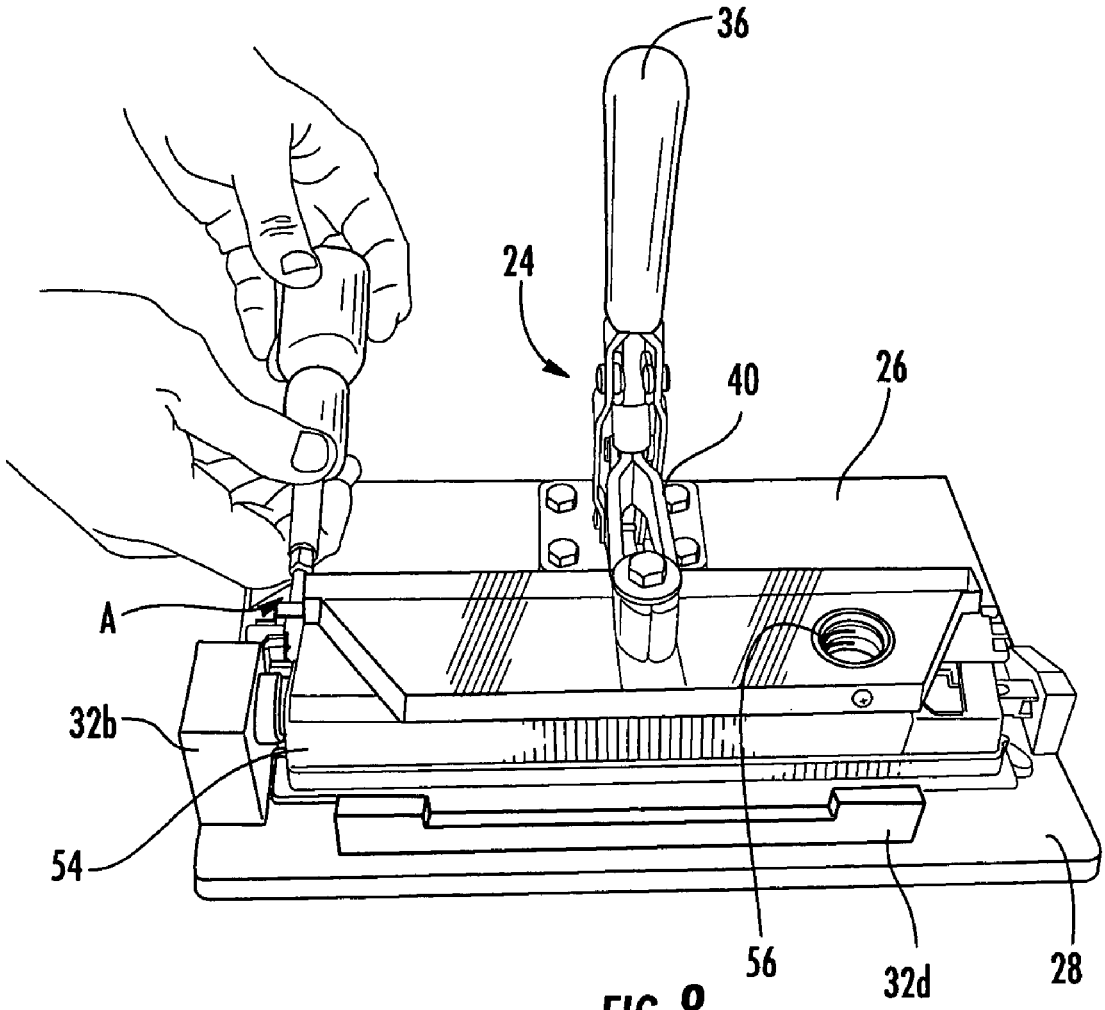
FIG. 8 is substantially a perspective view of the cartridge assembly device shown in FIG. 1 with the doctor blade being attached to the printer cartridge.

Referring now to FIG. 7, the doctor blade press 26 may be positioned on top of the elongated support rod 58 of the doctor blade to act as a source of pressure for the doctor blade. It is desirable to apply a substantially uniform pressure on the doctor blade when it is being attached to the cartridge so that the distance between the blade 60 and developer roller 62 is kept as level as possible throughout the lengths of the doctor blade and the developer roller. If said distance is kept as level as possible, the blade 60 can regulate the toner amount on the developer roller uniformly across the length of the developer roller. Referring now to FIG. 8, when the handle 36 is moved to the perpendicular position, the clamp 24 may provide additional pressure to the doctor blade press 26 that may be applied to the doctor blade. The clamp 24 may be locked in the perpendicular position, and the doctor blade 52 may be screwed onto the cartridge, such as at position "A" shown in FIG. 7.

It can now be realized that the present invention provides a device that may effectively hold a cartridge portion or an entire cartridge during assembly, toner refill, remanufacture, refurbishment, repair, or maintenance. As a result, a cartridge assembler may be able to work efficiently and quickly. The present invention may also provide devices and methods that effectively position the doctor blade proximate to the developer or mag roller during assembly, which may be beneficial in allowing the doctor blade to regulate the toner amount on the developer or mag roller. As a result, the print cartridge assembled, remanufactured, or maintained with the devices and methods of the present invention may provide high print quality. Finally, the present invention provides a template for creating a refill hole on a toner hopper, which may allow for an efficient toner refill procedure.

Although the description above contains many specifications, these should not be construed as limiting the scope of the invention but as merely providing illustrations of some of the presently preferred embodiments of this invention. For example, the shape of the base fixture may vary. Various clamp designs may be adopted. The doctor blade press 26 may be made or used with or without the clamp 24 and may still provide some of the advantages of the present invention. For instance, the doctor blade press 26 may be placed on top of the doctor blade by itself. Hand pressure may be applied to the doctor blade pressure while attaching the doctor blade to the cartridge. It can be appreciated that with this embodiment, the doctor blade press 26 is still able to apply a substantially uniform pressure on the doctor blade when it is being attached to the cartridge so that the distance between the blade 60 and developer roller 62 is kept as level as possible throughout the lengths of the doctor blade and the developer roller. The devices and methods of the present invention may be used in manufacturing or remanufacturing toner cartridges.

The invention is capable of other embodiments and of being practiced and carried out in various ways. The invention is not limited in its application to the details of the construction and to the arrangement of the components set forth in the above description or as illustrated in the drawings.

What is claimed is:

1. A method method of assembling a printer cartridge, the printer cartridge having a doctor blade and a developer roller, the doctor blade having a suuport rod and a blade portion attached substantially perpendicular to the support rod, the doctor blade being configured to regulate toner amount delivered to the developer roller, the method comprising:

a. laying the support rod of the doctor blade on the printer cartridge;

b. positioning the blade portion of the doctor blade and the developer roller proximate to each other the support rod being farther from the developer roller than the blade poition;

c. providing a pressure device d. pressing the pressure device against the support rod of the doctor blade; and e. fastening the doctor blade to the printer cartridge from a portion of the doctor blade that is positioned perpendicular to the support rod.

2. The method of claim 1, further comprising:

a. providing a fixture; and b. using the fixture to hold the printer cartridge.

3. The method of claim 1, farther comprising:

a. providing a clamp, the clamp being attached to the pressure device; and b. pressing the pressure device against the doctor blade using the clamp.

4. The method of claim 1, wherein the pressure device defines a recess the recess providing access to a printer cartridge portion, the method further comprising:

a. introducing a cutting device into the recess; and b. creating a hole on the printer cartridge, wherein the recess provides a hole template.

5. The method of claim 4, further comprising:

a. introducing toner in the hole; and b. covering a printer cartridge portion that defines periphery of the hole.

6. A method of assembling a printer cartridge, the method comprising:

a. setting a printer cartridge portion on a fixture;

b. positioning a template to contact the printer cartridge portion;

c. using the template to secure the printer cartridge portion to the fixture, the template defining a recess, the recess configured to lead to a toner hopper of the printer cartridge;

d. creating toner refill hole by introducing a cutting device into the recess; and e. cutting a portion of the toner hopper using the cutting device.

7. The method of claim 6, further comprising introducing toner into the toner refill hole.

8. The method of claim 6, further comprising covering the toner refill hole.

9. A method of manufacturing a printer cartridge, the method comprising:

a. setting a printer cartridge portion on a fixture;

b. positioning a template to contact the printer cartridge portion; the template defining a recess, the recess configured to lead to the printer cartridge portion;

c. providing a clamp, the clamp being attached to the template;

d. introducing a cutting device into the recess;

e. cutting the printer cartridge portion using the cutting device, wherein a size of the printer cartridge portion to be cut is detennined by a size of the recess of the template, wherein the printer cartridge includes a doctor blade and a developer roller, the doctor blade being configured to regulate toner amount delivered to the developer roller, the method comprising:

f. positioning the doctor blade and the developer roller proximate to each other, g. pressing the template against the doctor blade using the clamp; and h. fastening the doctor blade to the printer cartridge.

10. A device for manufacturing a printer cartridge, the printer cartridge having a doctor blade and a developer roller, the doctor blade being configured to regulate toner amount delivered to the developer roller, the device comprising:

a. a first surface, the first surface lying on a first palne;

b. a clamp attached to the first surface;

c. a base attached to the clamp, wherein the clamp and the base are configured to substantially prevent the cartridge from moving; and d. a second surface positioned opposite the first surface, the second surface lying on a second plane, the first and the second plane being parallel to each other, the second surface comprising a flat portion, the flat portion being configured to contact a portion of the doctor blade, wherein when the flat portion contacts the doctor blade portion, the device applies pressure to the doctor blade portion.

11. The device of claim 10, further wherein the clamp is configured to engage the flat portion to contact the doctor blade portion, the clamp being further configured to provide pressure on the doctor blade portion.

12. The device of claim 10, further comprising a fixture, the fixture being configured to support the printer cartridge, the fixture being further configured to prevent the printer cartridge from moving in a first direction.

13. The device of claim 10, further comprising a base, the base being configured to hold a portion of the printer cartridge.

14. The device of claim 10, further comprising a plurality of projections attached to the base, the plurality of projections being positioned perpendicular to the base.

15. The device of claim 12, wherein the clamp is configured to apply a downward pressure to the doctor blade portion.

16. A device for manufacturing a printer cartridge, the printer cartridge having a doctor blade and a developer roller, the doctor blade being configured to regulate toner amount delivered to the developer roller, the device comprising:

a. a first surface, the first surface lying on a first plane;

b. a second surface positioned opposite the first surface, the second surface lying on a second plane, the first and the second plane being parallel to each other, the second surface comprising a flat portion, the flat portion being configured to contact a portion of the doctor blade, wherein when the flat portion contacts the doctor blade portion, the device applies pressure to the doctor blade portion; and c. a recess traversing through the first and the second surfaces, the recess being configured to form the device into a template for creating a toner refill hole wherein thu recess may accommodate a cutting device and influeuce the physical characteristic of the toner refill hole.

* * * * *